US009597245B2

(12) United States Patent
Bricio Arzubide

(10) Patent No.: US 9,597,245 B2
(45) Date of Patent: Mar. 21, 2017

(54) OSCILLATING HYPERBARIC CAPSULE

(71) Applicant: Alvaro Fabian Bricio Arzubide, Tiajomulco de Zuniga (MX)

(72) Inventor: Alvaro Fabian Bricio Arzubide, Tiajomulco de Zuniga (MX)

( * ) Notice: Subject to any disclaimer, the term of this patent is extended or adjusted under 35 U.S.C. 154(b) by 0 days.

(21) Appl. No.: 14/778,594

(22) PCT Filed: Mar. 21, 2013

(86) PCT No.: PCT/MX2013/000036
§ 371 (c)(1),
(2) Date: Sep. 20, 2015

(87) PCT Pub. No.: WO2014/148880
PCT Pub. Date: Sep. 25, 2014

(65) Prior Publication Data

US 2016/0143797 A1 May 26, 2016

(30) Foreign Application Priority Data

Mar. 20, 2013 (MX) ..... MX/a/2013/003117

(51) Int. Cl.
*A61G 10/02* (2006.01)
*A61G 7/005* (2006.01)
*B63C 11/36* (2006.01)

(52) U.S. Cl.
CPC ..... *A61G 10/026* (2013.01); *A61G 7/005* (2013.01); *B63C 11/36* (2013.01)

(58) Field of Classification Search
CPC ..... A61G 10/26; A61G 10/04; A61G 7/005; A61G 11/08; A62B 31/00; B63C 11/36
USPC ..... 128/205.26
See application file for complete search history.

(56) References Cited

U.S. PATENT DOCUMENTS 6,352,078 B1 * 3/2002 Harvey ..... B63C 11/32 128/200.24
2013/0204074 A1 * 8/2013 Belval ..... A61G 11/00 600/22

* cited by examiner

*Primary Examiner* — Peter S Vasat
*Assistant Examiner* — Margaret Luarca

(57) ABSTRACT

This invention makes reference to an autonomous, versatile and non-invasive hyperbaric capsule with a new functional and esthetic design for high-pressured air or oxygen therapies for one or more people which can be installed to any structure. It has vertical to horizontal oscillating effect and features a new bolted gate with a 2-movement, 3-position twin closure mechanism. Also, it has all the necessary equipment already built in ready to be operated according to the wishes of the patient inside or by an assistant in the outside.

1 Claim, 9 Drawing Sheets

OSCILLATING HYPERBARIC CAPSULE

FIELD OF THE INVENTION

Figure 1:
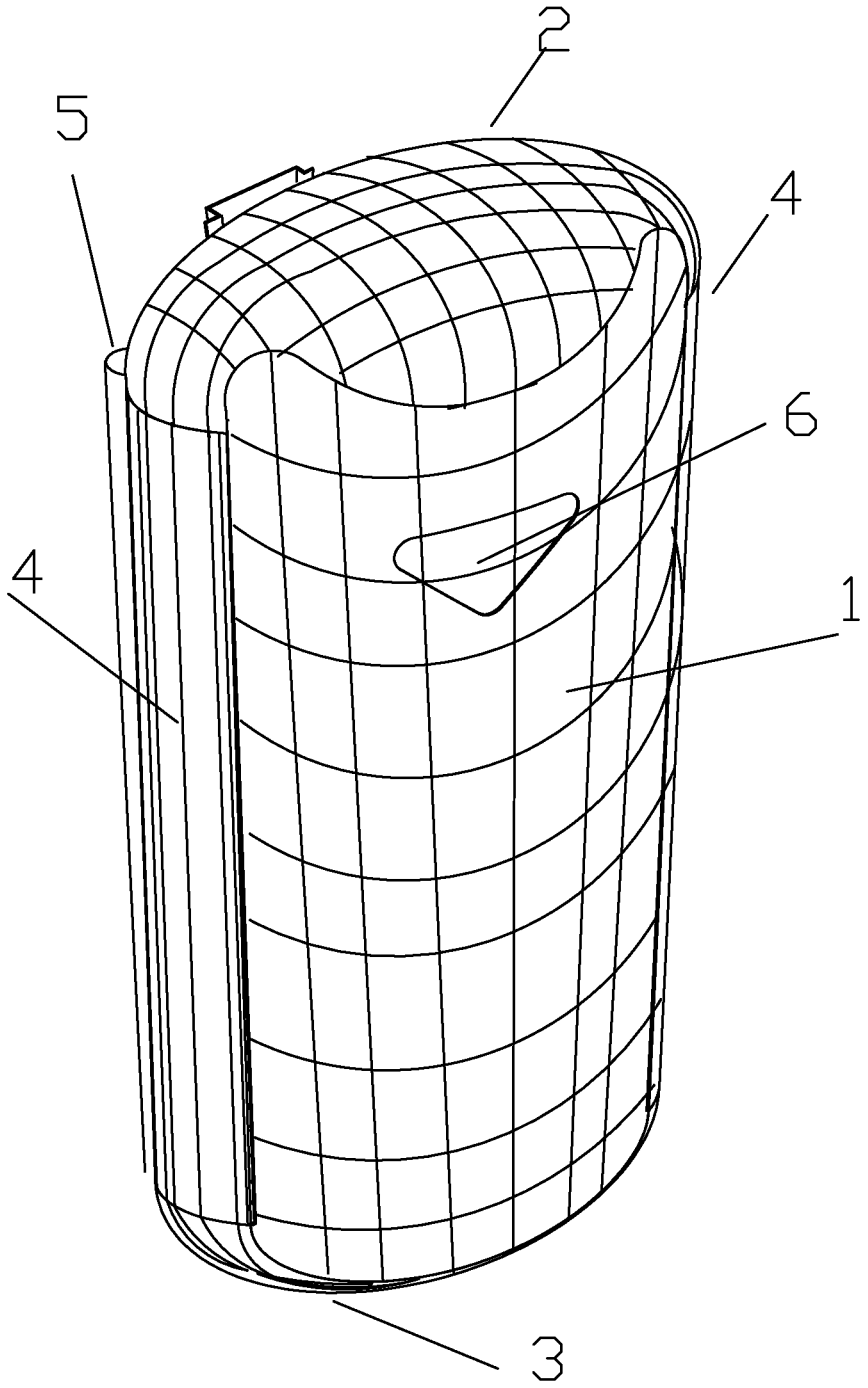

The following invention refers to pressurized chambers or capsules used in hyperbaric oxygenation therapies for human beings by exposing them to hyperbaric conditions over a fixed amount of time. The referred capsule creates a pressurized environment above normobaric conditions where oxygen-enriched air is breathed by the patient. This therapy is named hyperbaric oxygenation (HBOT) and is used to treat a wide range of medical and physiological conditions.

BACKGROUND OF THE INVENTION

Hyperbaric oxygenation therapy (HBOT) is a medical procedure approved by the FDA (Federal Drug Administration, USA) where a patient is placed inside a pressurized (hyperbaric) chamber, breathing air with an oxygen concentration of 21 to 100 percent. According to the FDA, this therapy is prescribed for medical conditions such as decompression sickness in divers, pressure ulcers, radiation necrosis, acute carbon monoxide poisoning, acute gas embolism, gas gangrene, refractory osteomyelitis, acute traumatic ischemia, acute cyanide intoxication and acute cerebral edema, among others. Furthermore, there are many medical reports showing the positive results of this therapy applied in patients suffering from critical conditions such as thermal burns, bone grafts, acute poisoning by carbon tetrachloride, fracture healing, multiple sclerosis, sickle-cell disease, autism and numerous other conditions.

Some of the benefits of HBOT include: Increasing oxygen concentration in all body tissues, stimulation of new blood vessels in areas with poor blood circulation, and improvement of blood flow to areas with arterial blockage. It also causes rebound arterial dilation at the end of the therapy, resulting in an increase in diameter of the blood vessels. This leads to an improvement of blood flow to the organs of the entire body (perfusion), and stimulates an increase in the production of superoxide dismutase (SOD), a major antioxidant and free radical scavenger (internally produced by the body). It also helps in the treatment of body infections by improving the performance of white blood cells among many other positive physiological mechanisms of the human body.

Traditionally, a hyperbaric chamber is cylindrically shaped, equipped with a rounded door in one of its side ends in which the patient can access in upright position or laid down its back. It is placed in a large room due to its big size and there is a small hatch where patients access the chamber, this design seems to be dictated by the necessity of minimizing the hatch (door) area in order to minimize the force applied to it when the chamber is pressurized. The traditional hyperbaric chamber must be placed in a large room (even larger if the patient enters in the upright position), this requirement is valid not only to accommodate the chamber but also to accommodate the rest of the equipment required for its operation. In these cases, owners need to reserve a large area or room in their facilities to accommodate the chamber, reducing the possibilities for small hospitals or clinics to install one, because of its high cost and the space required.

The inconveniences mentioned before, added to the high cost of hyperbaric oxygenation therapy in clinics and hospitals, have limited the therapy's range of treatment to only a few facilities that have used them for medical conditions (where effectiveness of hyperbaric oxygen therapy has been proven successful) and have limited the reach of studies into the use of HBOT in other medical conditions where it may have a potential benefit to health.

Since the common HBOT therapy is daily treatments for one or two hours over one or more weeks, its represents for many patients a major challenge, not only because of the therapy's high cost, but also because of transportation expenses resulting from getting to one of these facilities that are located in hospitals and clinics not always near the patient's house.

Several patents have been submitted for hyperbaric chambers; these are made of rigid materials such as steel, or soft materials such as plasticized fiber cloth. Other characteristics that these chambers display are their spacious size or "assembly required" design. Currently there are no hyperbaric chambers made of soft materials that make an internal pressure above 1.3 ATA possible, and there is no hyperbaric chamber made of rigid materials designed to support 3.0 ATA or more, with a mechanism that allows the chamber to oscillate from a vertical to a horizontal position, is compact enough to be installed in a small clinic or at home and can be operated either by the technician, the user and/or a remote 3$^{rd}$ party.

U.S. Pat. No. 5,327,904 by Hannum James E and also U.S. Pat. No. 7,556,040 B2 by Allan Dolph Meyer, Norman Michael Berry and James Martin Davidson show a rigid material hyperbaric chamber with its entrance designed to insert the patient backwards in a sitting position. It allows no possibility of being reclined at any angle. Furthermore, none of the gate designs in these patents show a bolted door.

A similar situation occurs with U.S. Pat. No. 5,398,678 granted to Rusten and Gamow in which they present a chamber that is made of soft materials, here the time required to assemble the hyperbaric chamber and set it up for a therapy session is very long and inconvenient. In addition, this version of the chamber is too big as to be accommodated in a regular size room. (Due to its composition, this type of soft material chamber offers limited benefits for hyperbaric oxygenation therapy being that it is not possible to pressurize them fully to the required levels.)

Another patent in a similar situation is No. 2008/0006272 A1 by Peter A. Lewis; this model of folding chamber is made of soft materials and lacks a rigid, bolted gate, neither does it offer any possibility of inclination for the patient. Additionally, U.S. Pat. No. 6,352,078 by David E. Harvey and Charles Wright features a closing mechanism, but in this design the gate lacks rebar bolts inserted in the internal face of the edge of the chamber's entrance, and there is practically no movement that allows the pressurized air to aid in sealing the gate through its displacement towards the internal face of the chamber's entrance.

In FIGS. 3A, 3B, 3C, 5, and 9 of this patent it is not clear how the external surface of the gate No. 62*b* moves against the internal surface of the chamber No. 26*b* because of the end of the bolt No. 98 or because of the air pressure, being that the gate's movement in this direction is blocked at all times by the lower track of the gate No. 138.

The invention being presented creates the possibility of HBOT being accessible to many people due to the following reasons:

1.—Ridgid Materials—this capsule can endure several times the atmospheric pressure.

2.—Oscillating Mechanism—this invention solves the problem of the space that is needed to install and operate this type of machine; it can be placed anywhere without compromising big spaces.

3.—Resource and time savings for the patients because by having it at hand they have the possibility of attending therapy sessions as frequently and for as long as they wish (always under a medical regimen).

4—It offers the possibility of starting HBOT immediately without any assembly of parts such as is required with hyperbaric chambers made of soft materials.

5.—The oscillating mechanism allows the patient to choose positions starting at any angle between vertical and horizontal, including inverted positions.

DESCRIPTION OF THE INVENTION

This patent application introduces a functional and esthetical design for the hyperbaric capsule. It features a new oscillating mechanism situated at the back, a new bolted side gates design with twin closure mechanisms placed in the upper and lower parts of the capsule that will enable the patient to open and close the bolted gate easily in a reduced space, providing convenient access to the capsule through either one of its two side doors.

This hyperbaric capsule, with all of the features listed above, resolves many of the troubles the patient has to go through due to the following reasons:

One.—The oscillating mechanism achieves a non-invasive fully integrated ridgid material capsule, capable of withstanding several times the atmospheric pressure.

Two.—The capsule can be operated from either inside or outside, or even remotely.

Three.—The bolted gates have an innovative twin closure mechanism (located in the upper and lower side) featuring a 2-movement and 3-position gate operation. This ensures a hermetic seal even in a reduced space, and helps maintain the mechanical integrity of the capsule when the pressure rises.

Four.—Due to its oscillating mechanism, the patients can be placed in positions from vertical to horizontal as well as points in between, additionally the patients position can also be inverted, this characteristic is very important when high blood flow to the brain is needed in HBOT.

Five.—It is compact and fully integrated because all the hydraulic, pneumatic, and electric controls that are necessary to operate the capsule, as well as the required equipment to energize the oscillating mechanism, are installed in the upper, lower or back side of the capsule.

Six.—The capsule's design can be scaled in order to increase its capacity to more than one person at a time.

Seven.—Entrance and exit are made through one of the two lateral gates. This is a safety feature that reduces the possibilities of an accident caused by a malfunction in the opening of the bolted gates. The capsule is made in its entirety with resistant materials such as stainless steel, titanium or aluminum. The machines that are used to produce the dimensional conformation of the pieces are presses, benders, and milling machines. Electric welding joints or high-strength steel fasteners are used for assembly so it meets the international standards for this type of equipment. Once completed, it supports the required resistance to: Endure several times the atmospheric pressure inside the capsule, operate the oscillating mechanism, and guide the movement of the capsule from vertical to horizontal (and vice versa).

A normal therapy begins with the capsule in an upright position and both exterior doors opened. In order to allow access to the users, the bolted doors will remain open as well, then the patient has to climb the built-in platform that is included for this sole purpose. The next step for the patient will be to close the bolted gates (which can be manually operated) and increase the interior pressure of the capsule with the admission of regulated pressurized air, which will help with the hermetic closure of the doors. Then, the inclination of the capsule will be operated and the patient can now enjoy the hyperbaric therapy. When the session's time has ended, or the patient wishes to leave the capsule, an exit routine returns the capsule to atmospheric pressure and a vertical position. Once the internal pressure is the same as that of the exterior, the bolted gates are easily opened and the patient can exit.

Having explained the nature of this invention, this text will now continue with examples in reference to the attached drawings wherein is shown the twin closure mechanism manually actuated as well as with force cylinders. Experts in the technique will perceive that many variations and modifications can be devised without departing from the scope of the invention as previously described.

Example 1

Oscillating hyperbaric capsule made with ridgid materials; its bolted gates are operated by a twin closure mechanism of 2 movements and 3 positions, triggered either manually or with force cylinders.

Attached drawings:

FIG. 1: Exterior view of the capsule with its gates closed.

Figure 2:
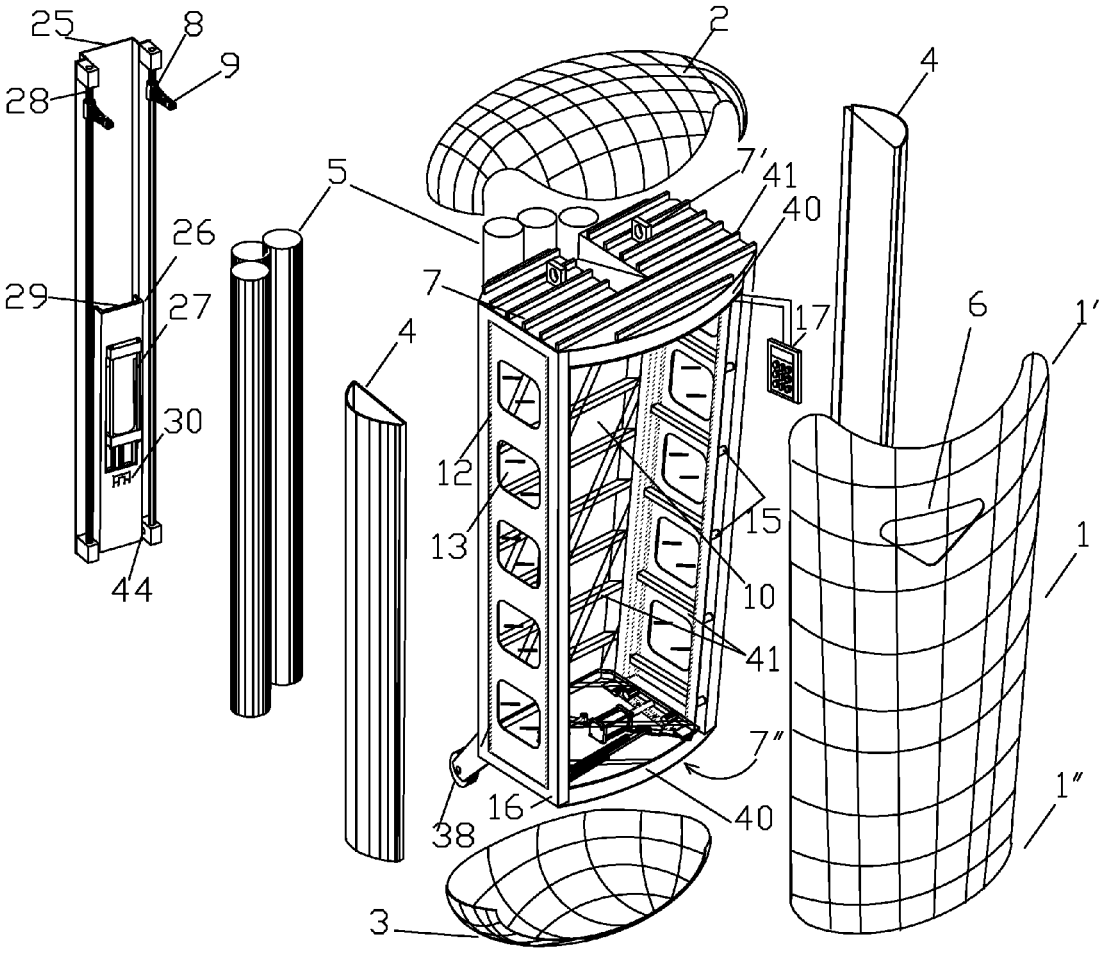

FIG. 2: Exterior view (exploded) of the capsule.

Figure 3:
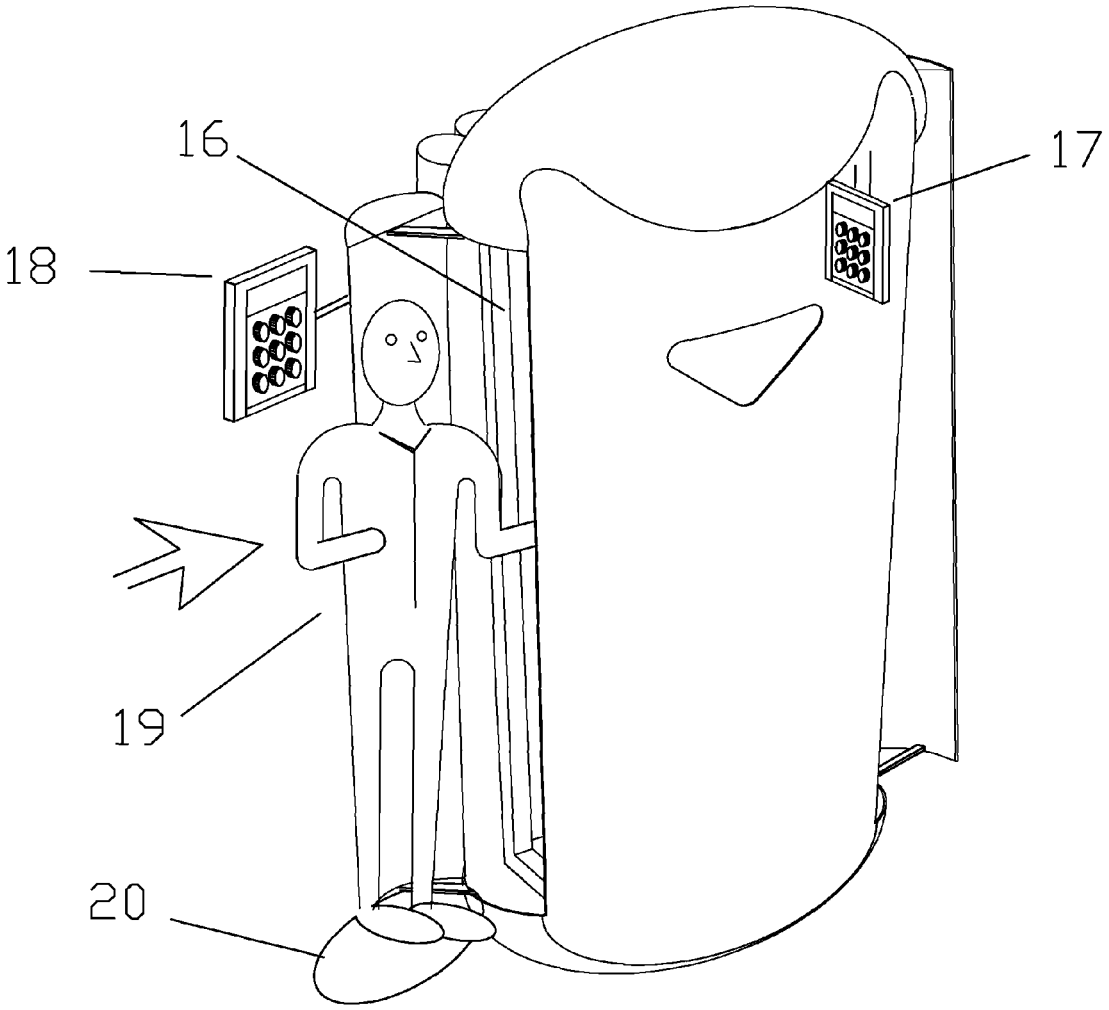

FIG. 3: Exterior view of the capsule with the patient entering.

Figure 4:
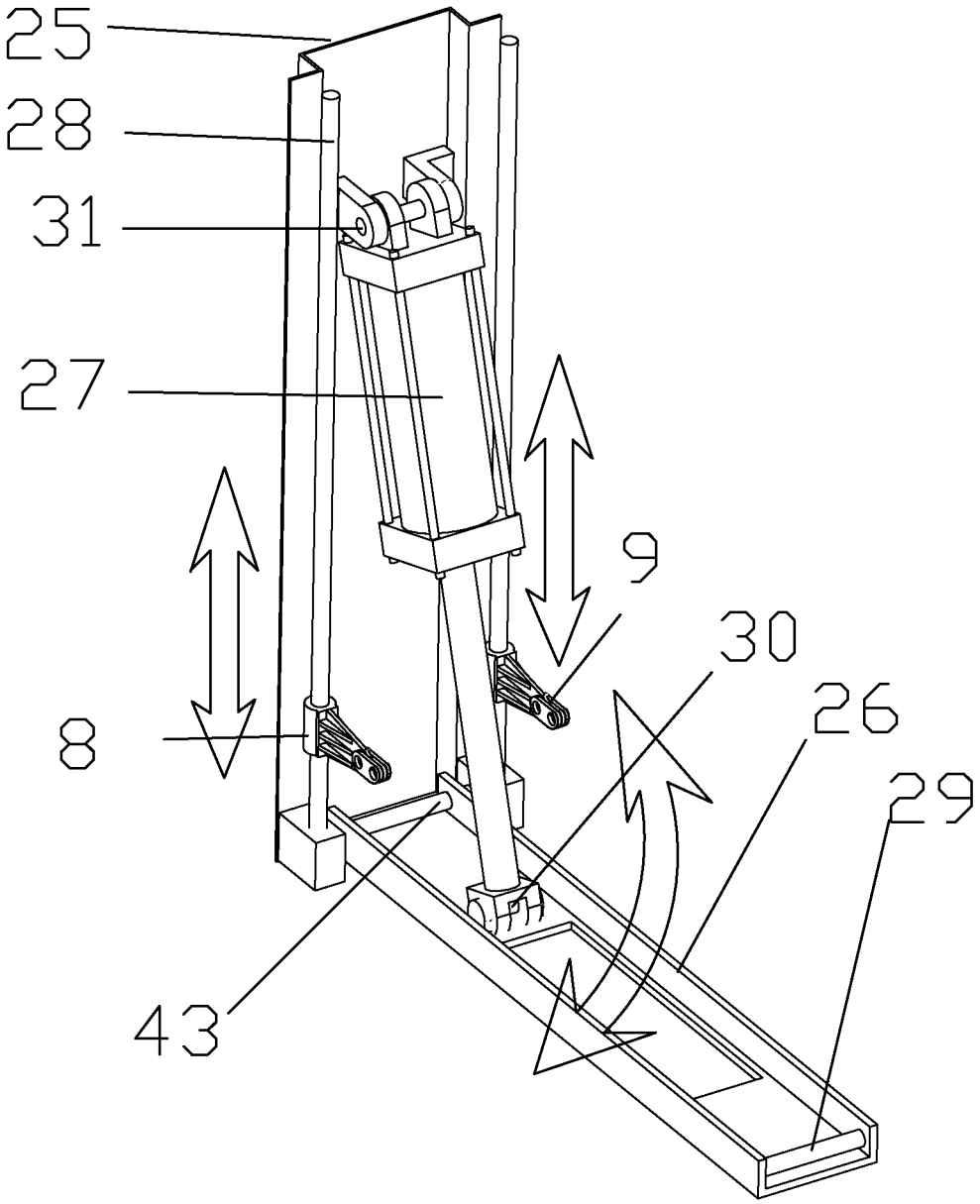

FIG. 4: View of the oscillating mechanism (capsule removed).

Figure 5:
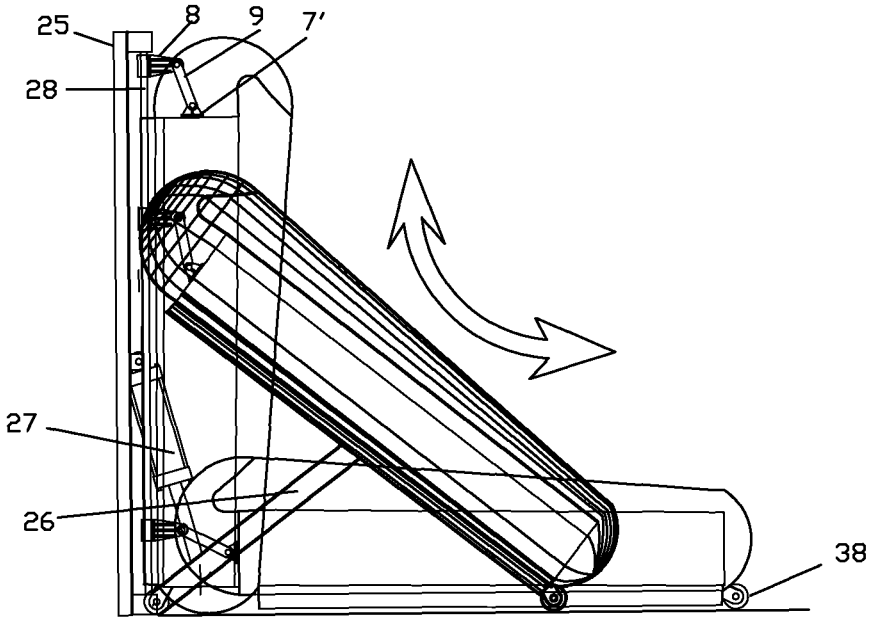
Figure 5:
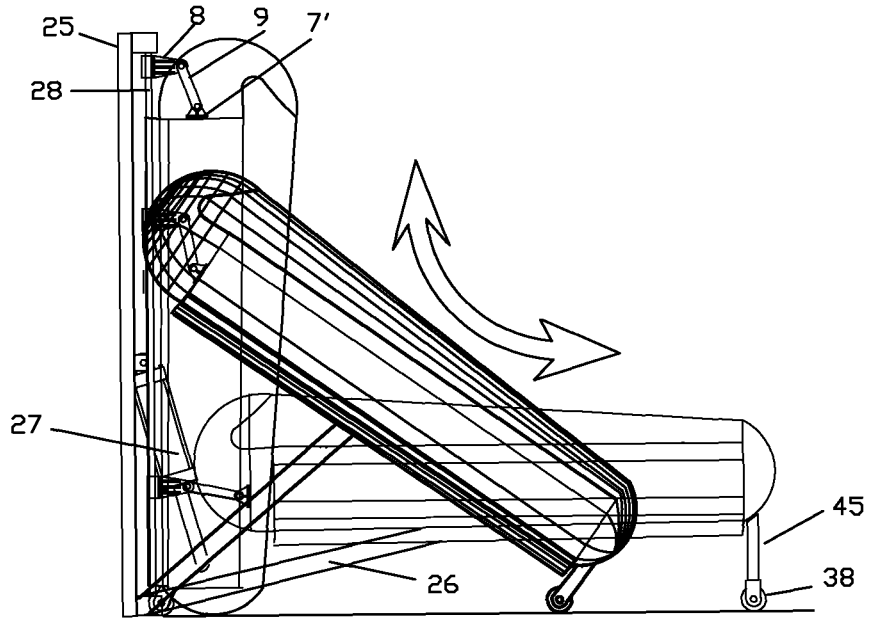

FIG. 5: Side view of the oscillating mechanism with the capsule attached to it. The drawing shows upright, inclined and horizontal positions.

Figure 6:
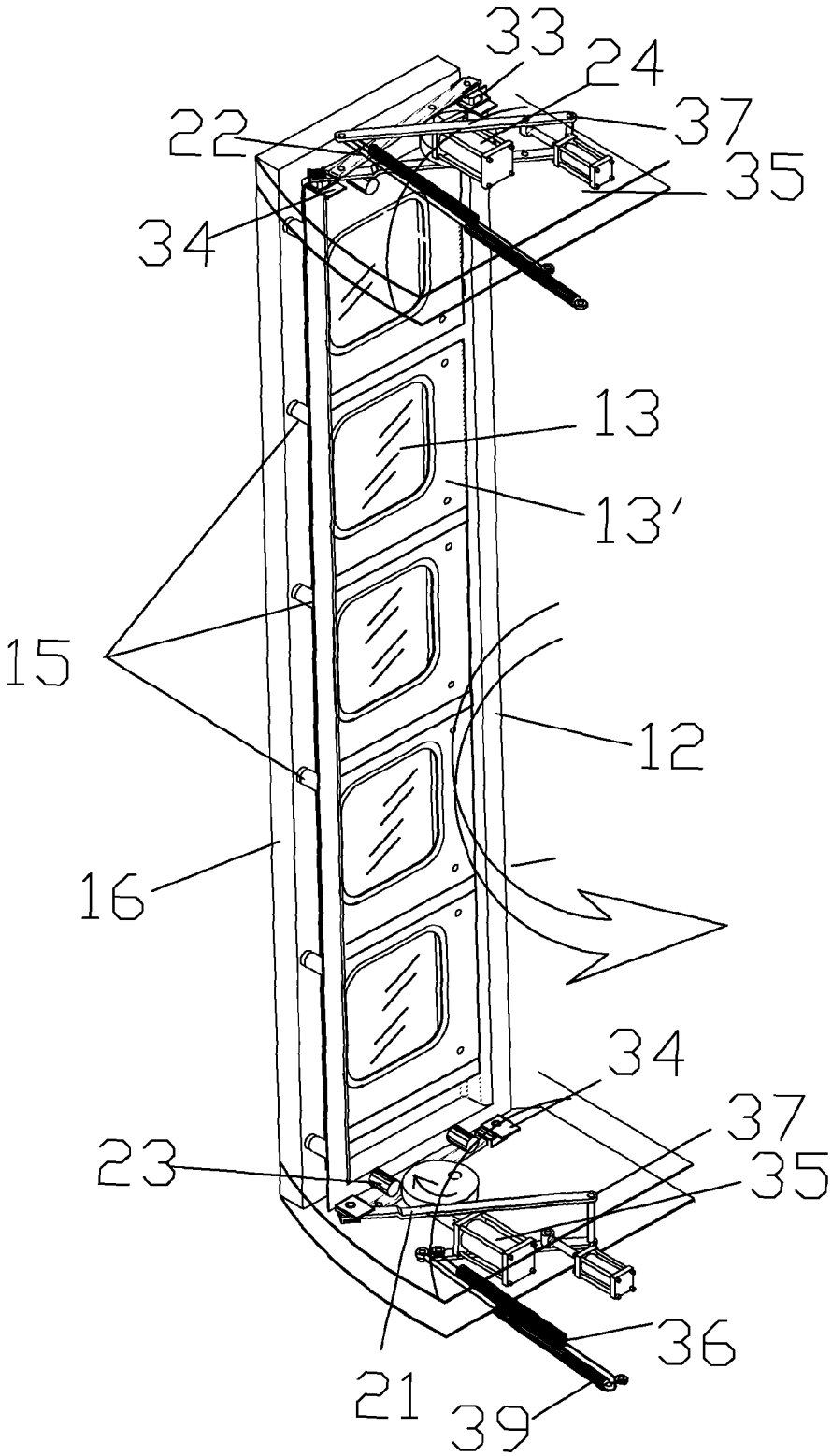

FIG. 6: Interior view of the bolted gate and the twin closure mechanism.

Figure 7:
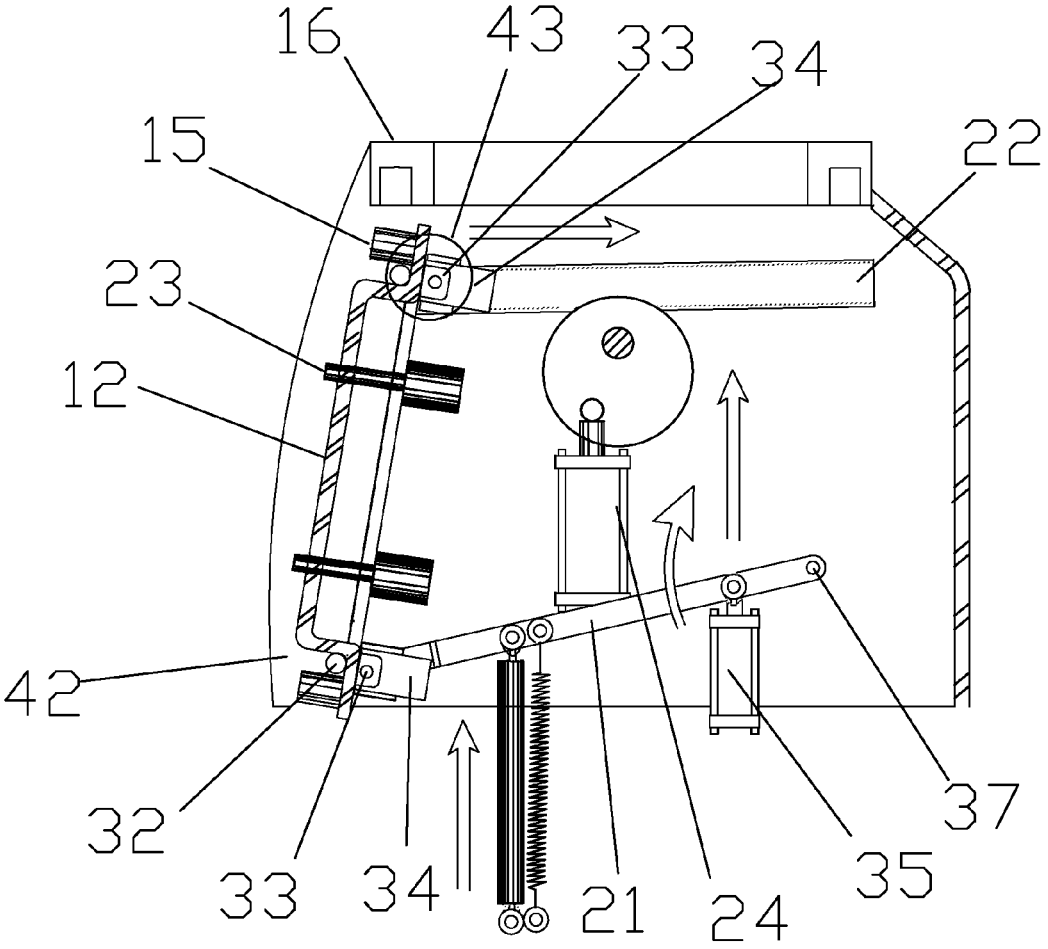
Figure 8:
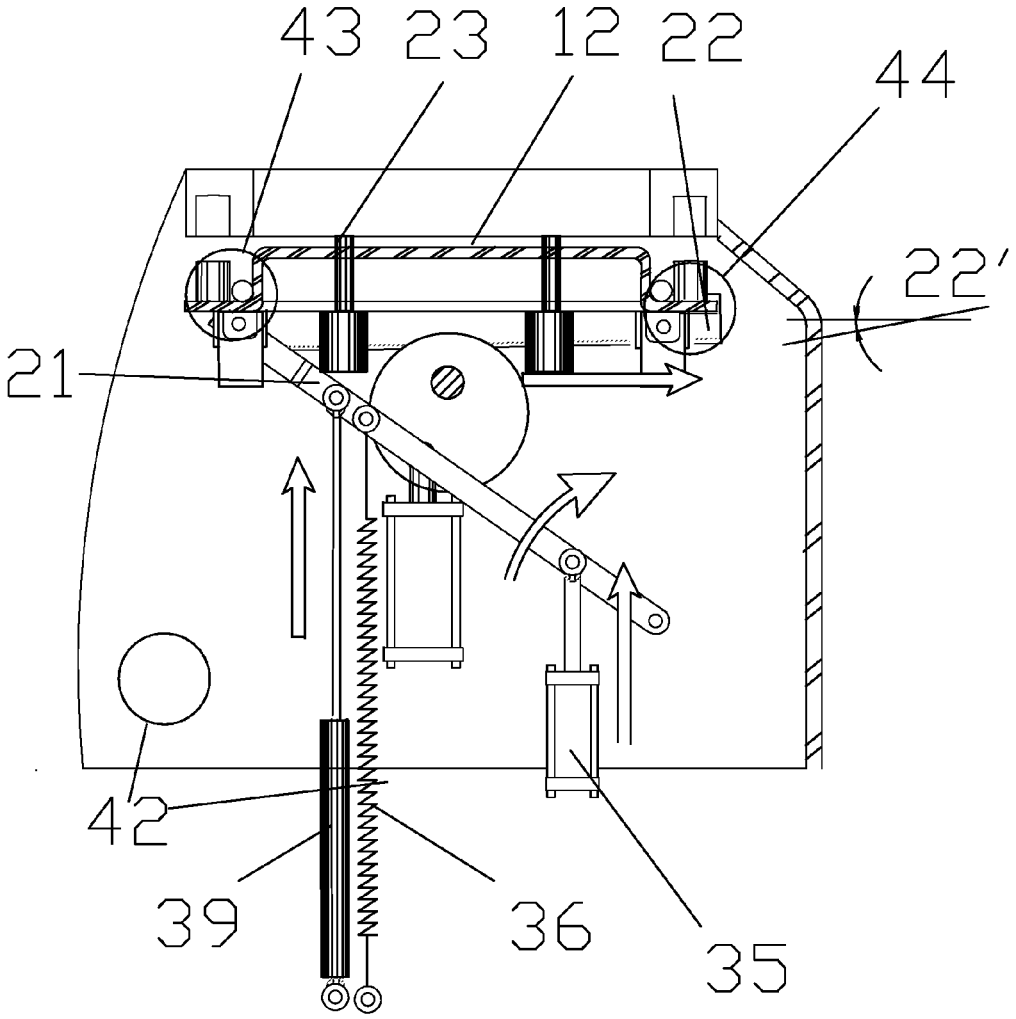
Figure 9:
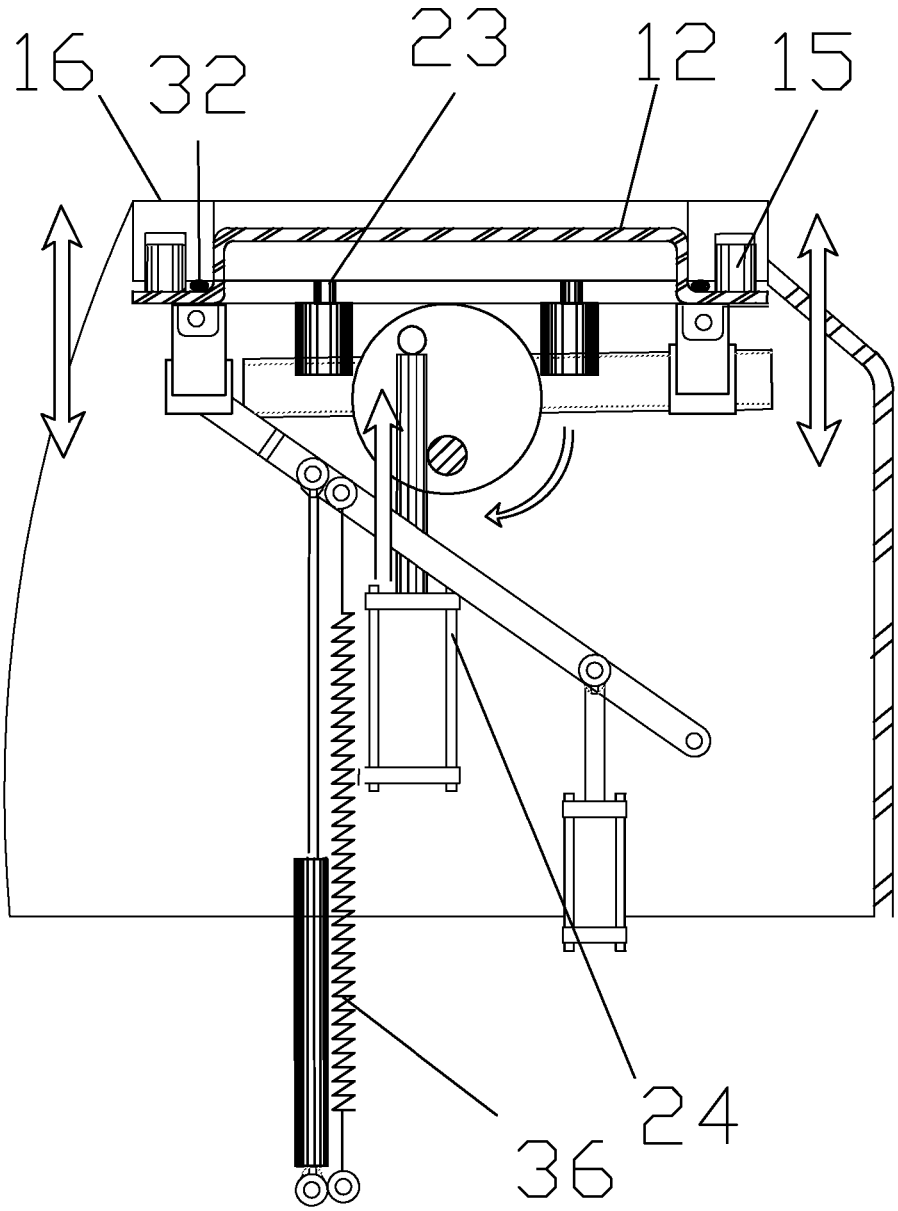

FIGS. 7, 8 and 9: Example of the manual actuation of the 2-movement closure mechanism (rotation and translation) and 3 positions of the interior bolted gate. FIG. 7.—Open Position, FIG. 8.—Pre-Closed Position, FIG. 9 Closed Position.

FIG. 1 shows an example of the invention.

FIG. 2 shows a full exploded diagram of the invention which models: the cover of the capsule #1, the upper cover #2, the lower cover #3, two exterior doors #4, interior bolted gates #12, two access frames #16, an upper plate #7, a lower plate #7, and a base #10, structural reinforcements #41 are installed for strengthening purposes, two vertically displaced carriage bearings #8 for the alignment and two links #9 are connected to the capsule in the plate #7 forming a hinge; the last 3 pieces are part of the oscillating mechanism of the capsule.

An arm of the oscillating mechanism #26 of the capsule is actuated by force cylinders #27 hinged together with the bearing link #30, the arm of the oscillating mechanism is coupled to the base #10 of the capsule by a bolt bearing #29. The upper and bottom cover #3 are removable for easy access. The hydraulic, pneumatic, electric and electronic components used in the operation of the capsule are stored in both compartments of the capsule and on the rear frame. A mechanical system with two wheels #38 that operate in conjunction with the arm #26 slides the capsule from vertical to horizontal and allows it to be positioned at a convenient height above the floor.

The upper and lower plates of the capsule #7, #7" are reinforced on the outer face with a series of rectangular shapes #41 of durable material that prevent deformation of the plates when the capsule is pressurized. The bolted gate of the capsule #12 and the lower twin locking mechanism are shown in this figure. Two double-walled compartments #40 at the top and bottom of the capsule house the twin closing mechanisms, which function simultaneously when opening or closing the inner bolted gate #12. This twin closing mechanism is detailed in FIGS. 7, 8 and 9.

In FIG. 3, patients #19 enter the capsule through the gate frame #11 accessing laterally, i.e. through the right or left side; a folding step #20 helps the patient in this movement. The capsule is controlled by either the control panel #17 that is installed inside at the upper side or the one outside the capsule #18, and can also be controlled from a remote location via an Internet connection.

FIG. 4. In this view, wherein the capsule has been removed, the innovative oscillating mechanism of the capsule is shown, the oscillating arm mechanism Capsule #26 is driven in an up and down movement by force cylinders #27 which are hinged together at the junction of bearing #30, the other end of the cylinder is supported to the frame #25 through the bearing pin #31, the arm oscillating mechanism #26 is coupled to the base #10 of the capsule by the packed bolt #29. Two axial sliding carriages of bearing #8 are attached to the top plate of the capsule body through two links #9 coupled in the supports #7 of the upper plate shown in FIG. 2, upon being raised, arm #26 pushes the capsule in the same direction, axial displacement carriages of bearing #8 mounted on the two vertical bars #28 accompany the capsule on its way from its vertical to its horizontal position, arms with two wheels #38 operate together with the slide arm #26 and allow it to be positioned at a convenient height above the floor.

FIG. 5 shows three positions for the hyperbaric capsule (vertical, inclined and horizontal), created to efficiently achieve the tilting movement of the capsule. This new mechanism can be collapsed and placed in the rear of the base of the capsule #10 and occupies a much reduced space, as seen in previous figures.

FIG. 6 represents the new twin locking mechanism for the interior bolted gate #12, which is housed in the double-walled upper and lower compartments #40; also, item #13 shows the side windows of the capsule, which are made of transparent material, and the steel frame that holds them #13'. When the gate is set at position 3 (Closed), several hardened bolts #15, placed on the front of the inner gate #12, penetrate the gate's frame of the capsule #16, when pressured, these work to develop a shear reaction against any deformation of the capsule.

FIGS. 7, 8 and 9 detail diagrams of the twin bolted mechanism. The opening and closing movement of the inner gate is achieved by two similar sets of lock mechanisms located in each of the double-walled capsules #40: one at the top and one at bottom. The purpose of this new mechanism is to take advantage of the high pressure inside the capsule to produce a hermetic seal against the frame of the gate #16 preventing it from suffering any deformation when the capsule is being pressured and the gate #12 fully closes, thus reinforcing the structure of the frame of the gate #16 due to the cutting resistance force delivered by the hardened bolts #15 installed in the front face of the interior gate #12 that enter the frame of the gate #16.

The basic parts of the twin locking mechanism are: A pivot arm #21, a long bearing slider #22, a short bearing slider #34 and a plain bearing swivel. #33

This mechanism may be supplemented with other components for its automation such as: A power cylinder #35, a power cylinder with cam #24, a buffer #39, and an opening spring. #36

This mechanism is intended to achieve different positions for the internal bolted gate #12 from its opened position to its closed position through a pivoted arc movement in point #37 of the end of the gate and linear sliding on the other end of the bearing bar #22, thus placing it in a parallel position to the interior face of the capsule gate's frame #16. This arc movement helps achieve the maximum opening of the gates, getting as close as possible to the interior face of the covering #1 during the opening or closing routine with the purpose of maximizing the free space in the interior of the capsule.

The operation is as follows:

In FIG. 7 the four corners of the capsule's inner bolted gate #12 are mounted on a short slider bearing #34 and, at the same time, on a turntable bearing #33, also the two corners near the covering #1 are mounted at the end of the arms (upper and lower) of the locking mechanism #21, which pivots on the other end on a bolt and taper bearing #37. The other two corners of the internal bolted gate #12 will be assembled in the long scroll bar bearing #22 which will have a degree of opening #22' with respect to the internal face of the frame of the capsule's gate #16 to ease the closing motion.

In FIG. 8 by manually pushing the gate #12 (or by the action of cylinder #35) the arm of the mechanism #21 will move, in a circular path, two corners of the inner bolted gate #12 taking it from its opening position #42 to its pre-closed position #43, also the other two corners of internal bolted gate #12 will slide from their open position #43 to their pre-closed position #44. The clamping force of the user over the gate or the two springs #23 keeps a gap between the inner bolted gate #12 and the frame of the capsule's gate #16 allowing air-flow into the capsule.

In FIG. 9 the internal bolted gate #12 will move against the frame of the capsule's gate #16 when it is pushed by the user or when the cam of the cylinder #24 is actuated. The seal #32 will compress between the internal bolted gate #12 and the internal face of the frame of the capsule's gate #16 thus creating an airtight seal. At the same time, the bolts of the internal gate will penetrate the frame of the gate #16, preventing deformation from the force of internal pressure of the capsule (a buffer #39 that can be calibrated will help structure the closing mechanisms to work in a gentle way).

The opening of the inner bolted gate will follow the same path in reverse.

Finally it is worth mentioning that the compact design of this invention has been obtained by the functional analysis and the structural strength of each of its rigid parts, which has been achieved efficiently. Additionally, the role that each part plays in the mechanism also contributes to the final structural strength, i.e. the design of the arrangement of all the parts mentioned in this invention has efficiently obtained an excellent functional design and an excellent structural capacity or high mechanical strength which, as we have stated, allows its interior to withstand several times the atmospheric pressure.

Having described adequately my invention, I consider it an innovation and therefore I claim as my sole property the content of the following clause:

1. A hyperbaric capsule comprising:

a capsule body composed of rigid materials and sized for more than one user having, a pair of exterior access doors located on each lateral side of the capsule body;

a pair of internal bolted gates on each lateral side of the capsule body; and a pair of identical closure mechanisms wherein one is located on an upper side of the capsule body and one is located on a lower back side of the capsule body, the closure mechanisms operating in two movements with three positions and wherein a hermetic seal is made between the capsule body and the internal bolted gates when the closure mechanisms are activated to close the gate; and a metallic frame to support the capsule body on a wall or a vertical structure, wherein the frame houses an oscillating mechanism and wherein the oscillating mechanism enables the capsule body to move from a vertical to a horizontal position; and an internal control panel, an external control panel and a remote control panel.

* * * * *